US009102455B2

(12) United States Patent
Canfield et al.

(10) Patent No.: US 9,102,455 B2
(45) Date of Patent: Aug. 11, 2015

(54) HANDBAG PRESERVATION UNIT

(71) Applicants: Laurel Lanai Canfield, Highland, UT (US); Charles O. Canfield, Highland, UT (US); Jerome Miles, Spanish Fork, UT (US); Randall West, San Diego, CA (US)

(72) Inventors: Laurel Lanai Canfield, Highland, UT (US); Charles O. Canfield, Highland, UT (US); Jerome Miles, Spanish Fork, UT (US); Randall West, San Diego, CA (US)

(73) Assignees: Laurel Lanai Canfield, Highland, UT (US); Charles O. Canfield, Highland, UT (US); Jerome Miles, Spanish Fork, UT (US); Randall West, San Diego, CA (US)

( * ) Notice: Subject to any disclaimer, the term of this patent is extended or adjusted under 35 U.S.C. 154(b) by 0 days.

(21) Appl. No.: 13/957,281

(22) Filed: Aug. 1, 2013

(65) Prior Publication Data

US 2014/0034643 A1 Feb. 6, 2014

Related U.S. Application Data

(60) Provisional application No. 61/678,986, filed on Aug. 2, 2012.

(51) Int. Cl.

| | |
|---|---|
| ***B65D 85/00*** | (2006.01) |
| ***B65D 81/02*** | (2006.01) |
| ***A45C 5/04*** | (2006.01) |
| ***A45C 11/00*** | (2006.01) |
| ***A45C 13/02*** | (2006.01) |

(52) U.S. Cl.
CPC . *B65D 85/00* (2013.01); *A45C 5/04* (2013.01); *A45C 11/00* (2013.01); *A45C 13/02* (2013.01); *B65D 81/02* (2013.01)

(58) Field of Classification Search
CPC ..... B65D 85/00; B65D 81/02
USPC ..... 220/3.8, 212, 694; 223/89, 94
See application file for complete search history.

(56) References Cited

U.S. PATENT DOCUMENTS

| | | | | |
|---|---|---|---|---|
| 1,957,475 | A | 5/1934 | Roth | |
| 2,078,613 | A | 4/1937 | Sieber | |
| 2,141,839 | A * | 12/1938 | De Hokerk | 229/5.7 |
| 3,063,570 | A | 11/1962 | Kroner | |
| 3,160,279 | A | 12/1964 | Hovey | |
| 3,235,218 | A | 2/1966 | Graham | |

(Continued)

FOREIGN PATENT DOCUMENTS

| | | |
|---|---|---|
| BR | MU8802222 | 2/2011 |
| CA | 2386993 | 4/2001 |

(Continued)

OTHER PUBLICATIONS http://buystoreshelving.com/purse_display/RB_8/index.htm; Aug. 27, 2012.

*Primary Examiner* — Fenn Mathew
*Assistant Examiner* — Elizabeth Volz
(74) *Attorney, Agent, or Firm* — Brian J. Riddle; VanCott, Bagley, Cornwall & McCarthy P.C.

(57) ABSTRACT

A handbag preservation unit includes a suspension mechanism to connect with an upper portion of a handbag and support part of the weight of the handbag. The handbag preservation unit further includes a support surface configured to support a bottom of the handbag and support a remainder of the weight of the handbag.

13 Claims, 8 Drawing Sheets

(56) References Cited

U.S. PATENT DOCUMENTS

| | | | | |
|---|---|---|---|---|
| 3,443,729 | A * | 5/1969 | Hannum | 223/94 |
| D362,549 | S | 9/1995 | Beck | |
| 6,053,378 | A | 4/2000 | Doyel | |
| 6,915,930 | B2 | 7/2005 | Dixon | |
| 7,481,340 | B2 | 1/2009 | Murphy | |
| 7,527,157 | B2 | 5/2009 | Shinn et al. | |
| 7,810,654 | B1 | 10/2010 | Wang | |
| 8,011,484 | B2 | 9/2011 | McIntyre | |
| 2006/0076859 | A1 * | 4/2006 | Slappey | 312/311 |
| 2006/0226179 | A1 | 10/2006 | Hsu | |
| 2010/0264101 | A1 | 10/2010 | Ma | |

FOREIGN PATENT DOCUMENTS

| | | |
|---|---|---|
| EP | 1685776 | 8/2006 |
| EP | 1825791 | 8/2007 |
| GB | 1516320 | 7/1978 |
| JP | 2004-082968 | 3/2004 |
| JP | 2006254939 | 9/2006 |

* cited by examiner

HANDBAG PRESERVATION UNIT

RELATED APPLICATIONS

The present application claims priority under 35 U.S.C. §119(e) to U.S. Provisional Patent Application Ser. No. 61/678,986, which was filed on Aug. 2, 2012.

BACKGROUND

Handbags are functional fashion accessories that are typically carried by a handle or straps. The handbags can be made from a wide variety of materials, including leather. Handbags may include any number of compartments for the convenient transportation and storage of items. Individuals typically have a number of handbags that are suitable for different seasons, occasions, and coordinate with various outfits. Fashionable handbags can represent a significant investment and carefully storing them can maintain their esthetics and increase their lifetime.

BRIEF DESCRIPTION OF THE DRAWINGS

The accompanying drawings illustrate various examples of the principles described herein and are a part of the specification. The illustrated examples are merely examples and do not limit the scope of the claims.

Throughout the drawings, identical reference numbers designate similar, but not necessarily identical, elements.

DETAILED DESCRIPTION

Handbags are functional, fashion accessories with any number of pocket compartments. These handbags are typically carried by a handle or straps. When handbags are not in use, they are stored in a variety of ways. A user may lay a handbag on a horizontal surface, lay it in a box, or hang it from its handles. However, these storage techniques can result in damage and distortion of the stored handbags and when the handbags are later retrieved for use, their aesthetic and functional qualities may be degraded.

For example, a user may set their handbag on a shelf, table, storage container or any other surface. While placing the handbag on a surface may give support to the base of the handbag, it does not support the handles, nor does it assist in keeping the side walls of the bag erect. Without proper support, the handles and sides of the bag will collapse into/onto the handbag. If left in this state, the weight of the handles and sides will create crease and fold marks in the bag.

Another handbag storage technique is to suspend it on a hanger or hook by its own handles, placing all of the weight of the handbag on the straps. This method can damage the straps by elongating and over-stressing them, and also force the body of the handbag to compress together, creating wrinkles and dents that can become permanent over time. Furthermore, these methods of handbag storage also leave the handbags exposed to varying degrees of contaminants, such as dust and dirt.

The principles below relate to systems and methods for storing and preserving handbags. These systems and methods provide simultaneous support for a handbag from its base and from its handles, straps or from its upper portion. By supporting the handbag from the top and bottom, the shape and functionality of the handbag is preserved during storage. In addition, this method of storage significantly reduces potential distortion to the handbag because it places the handbag in an environment where its weight is distributed between two separate supports. Furthermore, while these systems and methods preserve the physical appearance of the handbag, they also prevent extraneous contaminants from reaching the handbags by keeping them within an enclosed volume. To increase visibility and accessibility, the handbag storage container may have a transparent or translucent portion that allows the user to view the handbag in the container.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an example" or similar language means that a particular feature, structure, or characteristic described in connection with the example is included in at least that one example, but not necessarily in other examples.

Figure 1A:
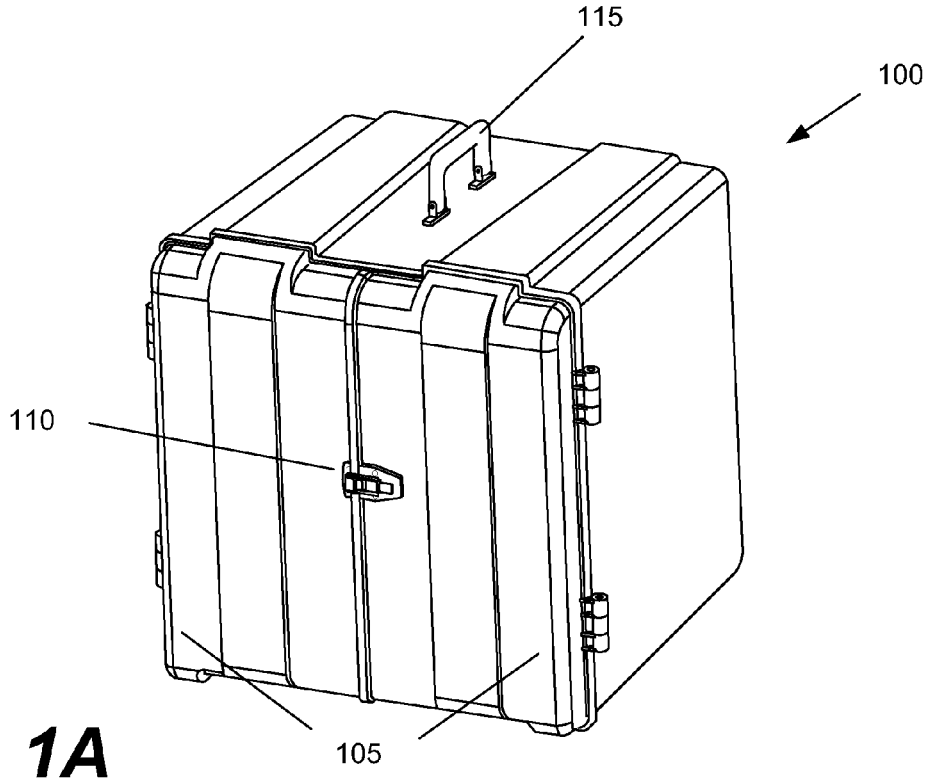
FIGS. 1A-1B depict two perspective illustrations of a Handbag Preservation Unit with both opened and closed doors, according to one example of principles described herein.
Figure 1B:
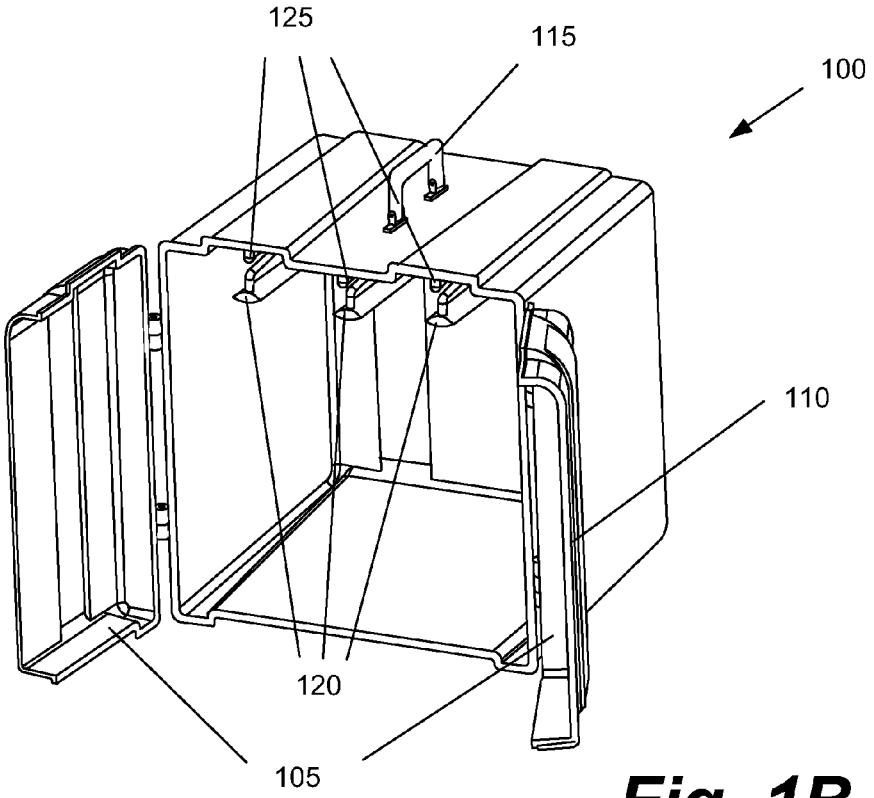

In one example, FIG. 1A shows a perspective view of a Handbag Preservation Unit (100) with closed clamshell doors (105) and FIG. 1B shows a perspective view of the Handbag Preservation Unit (100) with open clamshell doors (105). Both FIGS. 1A-1B illustrate a clamp lock (110) for the clamshell doors (105), and a handle (115) on top of the unit. FIG. 1B illustrates the interior of the unit. Inside the unit are three hangers (120) and three rods (125).

In this example, the Handbag Preservation Unit (100) is a large rectangular box that could be made of a durable plastic, metal, recyclable material, wood, et cetera. Its clamshell doors (105) open from the center of the container and hinge on the sides. The two parts of the clamp lock (110) are located at the end of each door so that they can lock together when closed. On top of the unit is a c-shaped handle (115) that can be used to carry and transport the unit. Inside the unit are three hangers (120) suspended from three rods (125). These rods (125) are attached to the ceiling of the unit.

Various handbags have differing heights and would require upper and lower support that cannot be achieved at one uniform level, but need to be supported at different heights.

Therefore, the Handbag Preservation Unit (100) implements an adjustable shaft for hangers.

Figure 2A:
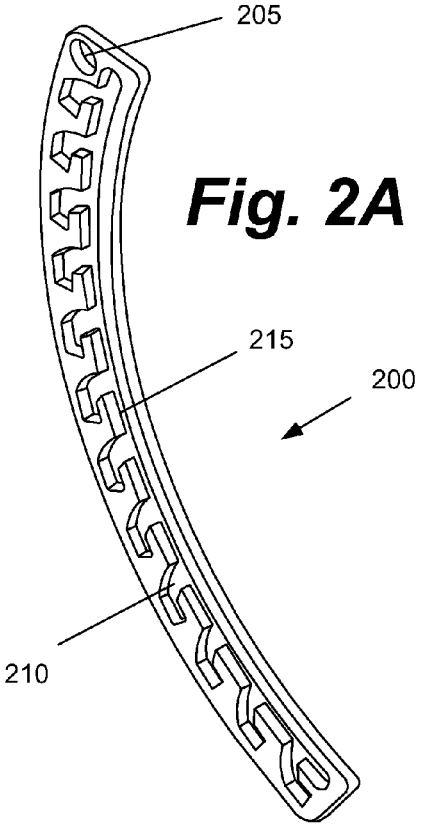
FIGS. 2A-2C show an arc-shaped shaft for use within the Handbag Preservation Unit, according to one example of principles described herein.
Figure 2B:
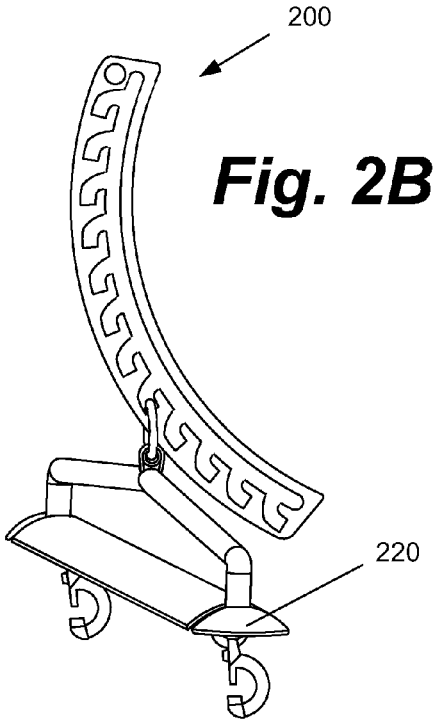
Figure 2C:
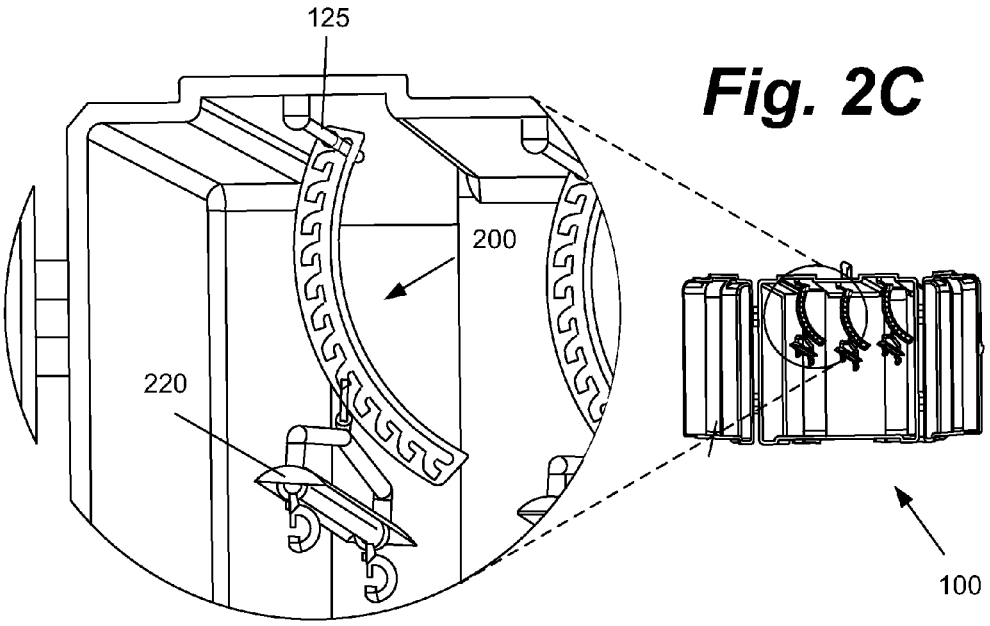

FIGS. 2A-2C depicts an adjustable shaft (200). This shaft could be made of metal, plastic or any other durable material. The shaft (200) curves upward in an arc-shape. At the top of the arc-shaped shaft (200) is a hole (205) and along the body of the shaft are L-shaped slots (210) linked together by a long curved slot (215).

This arc-shaped shaft (200) is to be used as a bridge between individual hangers and the rods (125) that are connected to the ceiling of the Handbag Preservation Unit (100). A user connects the arc-shaped shaft (200) to a rod (125), by inserting the rod (125) through the hole (205) at the top of the arc-shaped shaft (200). The user can then suspend individual hangers (220) along the arc-shaped shaft (200) by inserting a hook of the hanger (220) through the long curved slot (215) and placing it on an L-shaped slot (210) at a desired height (see FIG. 2B). These arc-shaped shafts (200) allow the hangers to be suspended without having the arc-shaped shaft (200) vertically plowing into a suspended handbag, which would create wrinkles and crease marks.

These arc-shaped shafts (200) slide on the rods (125) that are attached to the ceiling of the case (see FIG. 2C). With this feature, a user may adjust the depth of the arc-shaped shaft by pulling it towards the front of the Handbag Preservation Unit (100) or pushing it towards the back. This allows users to see what they are doing while they are attaching handbags, rendering it easier to attach the bags. For example, the user may pull a handbag, shaft (200), and hanger (220) forward to remove the handbag from the Handbag Preservation Unit (100). This will allow the user to clearly see the handbag and hanger (220) and conveniently remove the handbag (220) from the hanger.

The L-shaped slots (210) along the arc-shaped shaft (200) make it possible to vertically adjust the suspension of the hangers (220), thereby allowing users to distribute the weight of the handbag. For example, a user may have a small handbag that they wish to insert into the Handbag Preservation Unit (100). They may attach the straps of their handbag to the hanger (220) then place the hanger on one of the lower L-shaped slots (210). This will suspend the straps and sides of the handbag, but not stretch them, as the base of the handbag is supported by the unit floor.

Figure 3A:
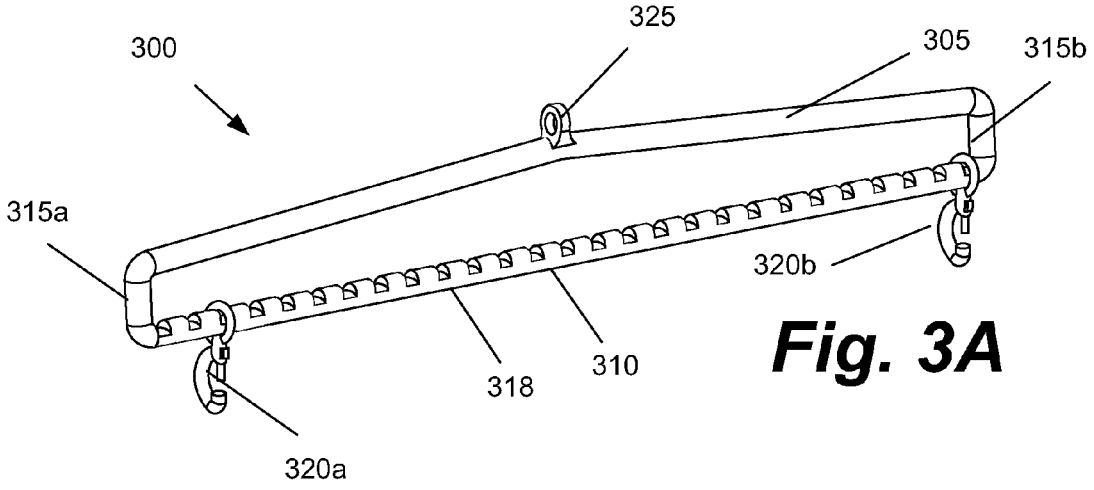
FIGS. 3A-3C is an illustrative example of a hanger configuration for the Handbag Preservation Unit, according to one example of principles described herein.
Figure 3B:
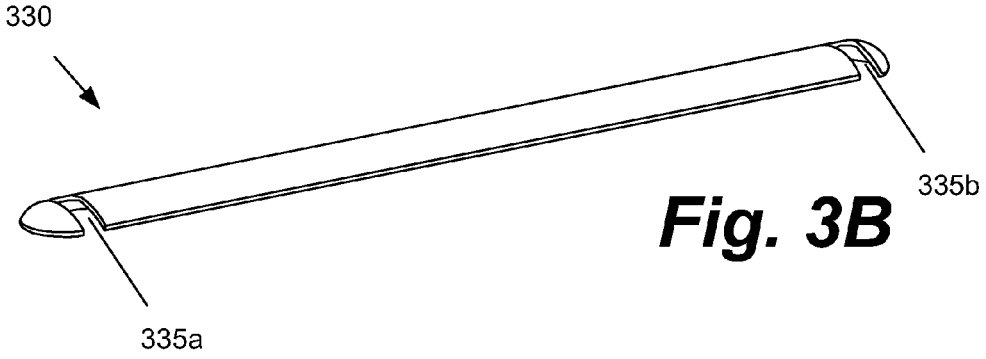
Figure 3C:
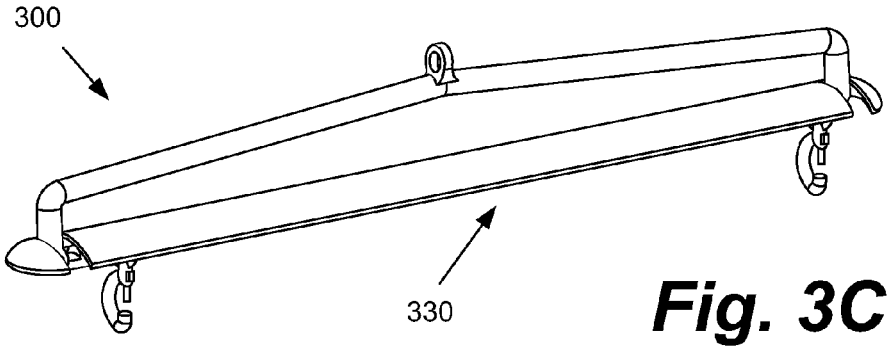

FIGS. 3A-3C illustrates several features of a hanger that could be used in the Handbag Preservation Unit. FIG. 3A shows a hanger (300) with an upper horizontal rod (305) and a lower horizontal rod (310), two vertical rods (315*a*, 315*b*), a mounted circular opening (325), and two clips (320*a*, 320*b*).

A hook may be inserted through the circular opening (325) at the top of the hanger (300) to connect the hanger (300) to one of the arc-shaped shafts (200, FIG. 2). The upper horizontal rod (305) is connected to the lower horizontal rod (310) by two vertical rods (315*a*, 315*b*). Along the lower horizontal rod (310) are a series of notches (318) in the upper surface of the lower horizontal rod (310). These notches (318) serve as resting places for the clips (320*a*, 320*b*) that are placed on the horizontal rod (310). The clips (320*a*, 320*b*) are used to attach to the rings at the ends of purses or handbags to keep their walls in moderate suspension and prevent them from collapsing. These clips cannot be too far apart; otherwise they will create tension and stretch the handbag. If the clips are too close together, wrinkles could be created in the handbag material. Therefore, the rings at the ends of the purse or handbag are suspended by clips (320*a*, 320*b*) placed in the notches (318). The clips can be adjusted along the length of the lower horizontal rod (310) to accommodate different sized handbags.

FIG. 3B is an illustration of a protective cover (330) made to conceal the hanger notches on the lower horizontal rod (310). The protective cover (330) is horizontal, long and flat, with a slight downward curve. At either end of the cover are two openings (335*a*, 335*b*), made to accommodate the vertical rods (315*a*, 315*b*) of the hanger.

FIG. 3C illustrates how the protective cover (330) fits over the lower horizontal rod (310) of the hanger (300). The protective cover (330) fits across the lower rod (310) and protects the handbag and external objects against the roughness of the notches (318). Furthermore, if a user has a handbag with a flap, the user can put the protective cover (330) over the hanger notches (318) and then close their flap over the protective cover (330). Instead of hanging from rings at the ends of the purse or handbag, the entire handbag can be suspended by its own flap over the lower horizontal rod (310) of the hanger (300). The cover is designed to protect the flap from the notches, preserve the shape of the flap and to prevent wrinkling.

Figure 4:
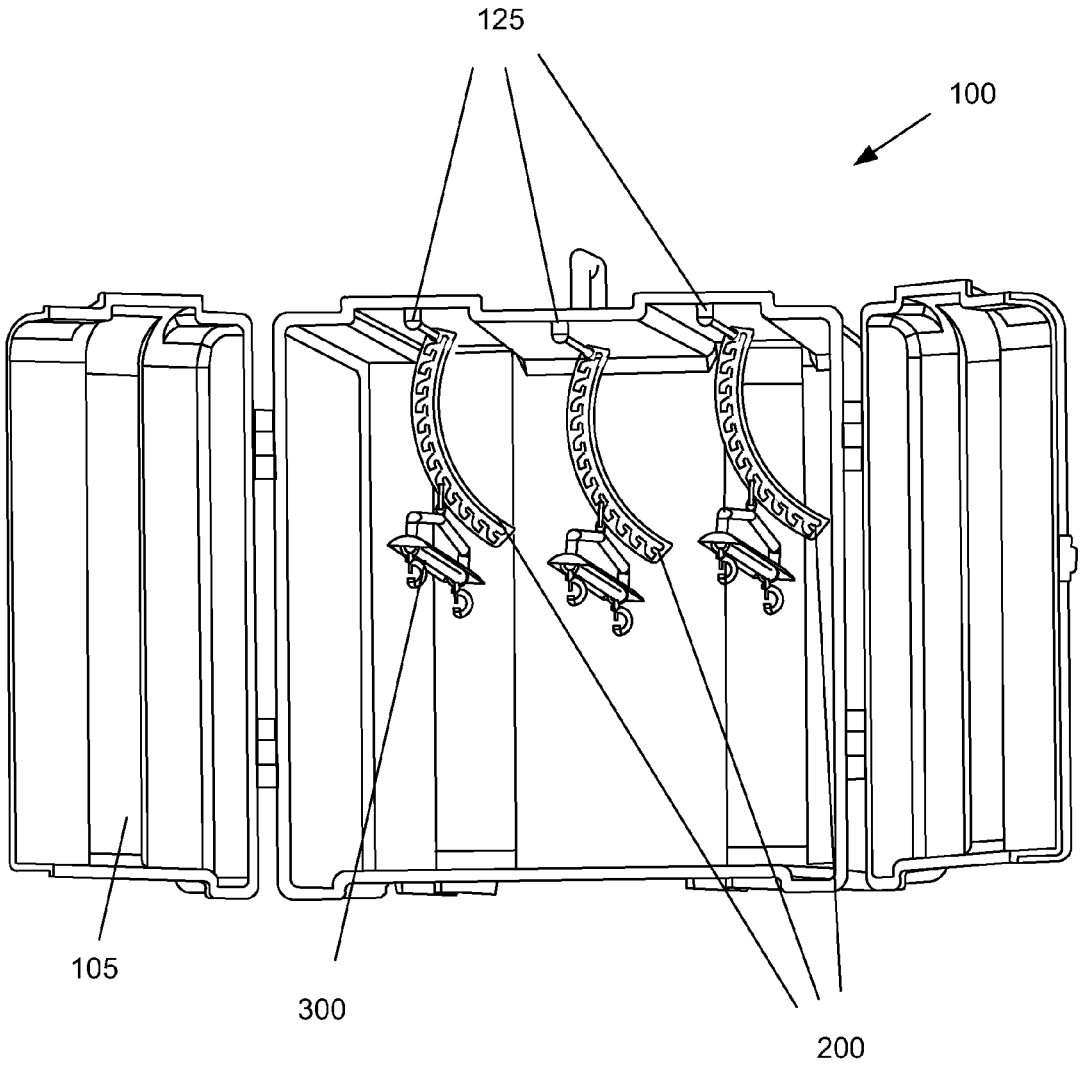
FIG. 4 is a perspective drawing of the Handbag Preservation Unit with hangers on the inside, according to one example of principles described herein.

FIG. 4 is a perspective view of the Handbag Preservation Unit (100) with open clamshell doors, exposing three ceiling rods (125), three arc-shaped shafts (200) and three hangers (300).

Various other hanger designs and implementations may be used to achieve proper suspension and weight distribution. The hanger may use a type of telescoping tube as its horizontal rod, allowing the user to adjust the distance between the angled sides. The angled sides of the hanger can be made from adjustable chains or ropes. Stretchable cords may also be integrated to aid in supporting the handbag. In other examples, the Handbag Preservation Unit (100) may have a transparent or translucent portion that allows the user to view their handbags within the container.

By supporting handbags from both the top and the bottom, equally distributing the handbag's weight and keeping it free of contaminants, the Handbag Preservation Unit offers consumers a suitable place to store their handbags.

The examples above describe a Handbag Preservation Unit is configured to store up to three handbags. However, a handbag preservation unit may store more or less handbags. For example, a handbag preservation unit may be configured to store a single handbag. In one implementation, the Handbag Preservation Unit may be appropriately sized to store a specific handbag. This eliminates the need for adjustability in the hanging mechanism. For example, the unit may include fixed pegs, latches, or other connectors that are spaced to directly receive the handbag and to support its upper portion. The enclosure of the unit is sized so that when the upper portion of the handbag is attached to the fixed connectors, the lower portion of the handbag is appropriately supported by the bottom interior surface of the unit. For example, if the handbag has a curved bottom, the bottom interior surface of the unit may have a similar curve. As discussed above, the handbag may be visible from the exterior of the unit.

To store multiple handbags, each handbag can be placed within its customized unit. The customized units completely enclose the individual handbags and are stored upright on a shelf, floor or other flat surface so that part of the weight of the handbag is suspended by its handles and a portion of the weight of the handbag is supported by the bottom of the unit. The individual units containing the handbags can be stored together, like books on a shelf. In some embodiments, a picture or other identification of the handbag stored in the units can be displayed on one end of each unit.

Additionally or alternatively, the individual Handbag Preservation Units may be reconfigurable to accommodate a range of handbags. For example, the suspension mechanism configured to connect with an upper portion of a handbag and support part of a weight of the handbag may be adjustable. Similarly, the support surface configured to support a bottom of a handbag and support a remainder of the weight of the handbag can be adapted to the particular shape of the handbag. This can be accomplished by using a conformable surface, an insert or other technique.

In general, the description above describes a handbag preservation unit that includes an exterior shell with at least one transparent wall. In some examples, the unit may include an insert to receive a handbag, in which the insert may include at least one upper support configured to engage with an upper portion of a handbag and a bottom surface conforming to a shape of a bottom of the handbag. When the handbag is placed in the insert and the insert is placed into the exterior shell, the upper portion of the handbag and lower portion of the handbag are simultaneously supported by the insert and possibly the exterior shell. In one implementation, the insert may be formed for a particular handbag and have a shape that conforms to a desired storage shape of the handbag. For example, the handbag may have a rounded bottom and the insert may be formed with a rounded interior cavity that supports the rounded bottom of the purse. In the example shown in FIG. 4, the inserts could rest on the bottom surface of the interior of the enclosure/shell. The insert may or may not engage with the upper portion of the handbag. The insert can be removed from the shell or repositioned within the shell according to the desires of the user. The insert may be formed from any appropriate material, including wood such as cedar or bamboo, metal, plastic, glass or other suitable material.

Figure 5:
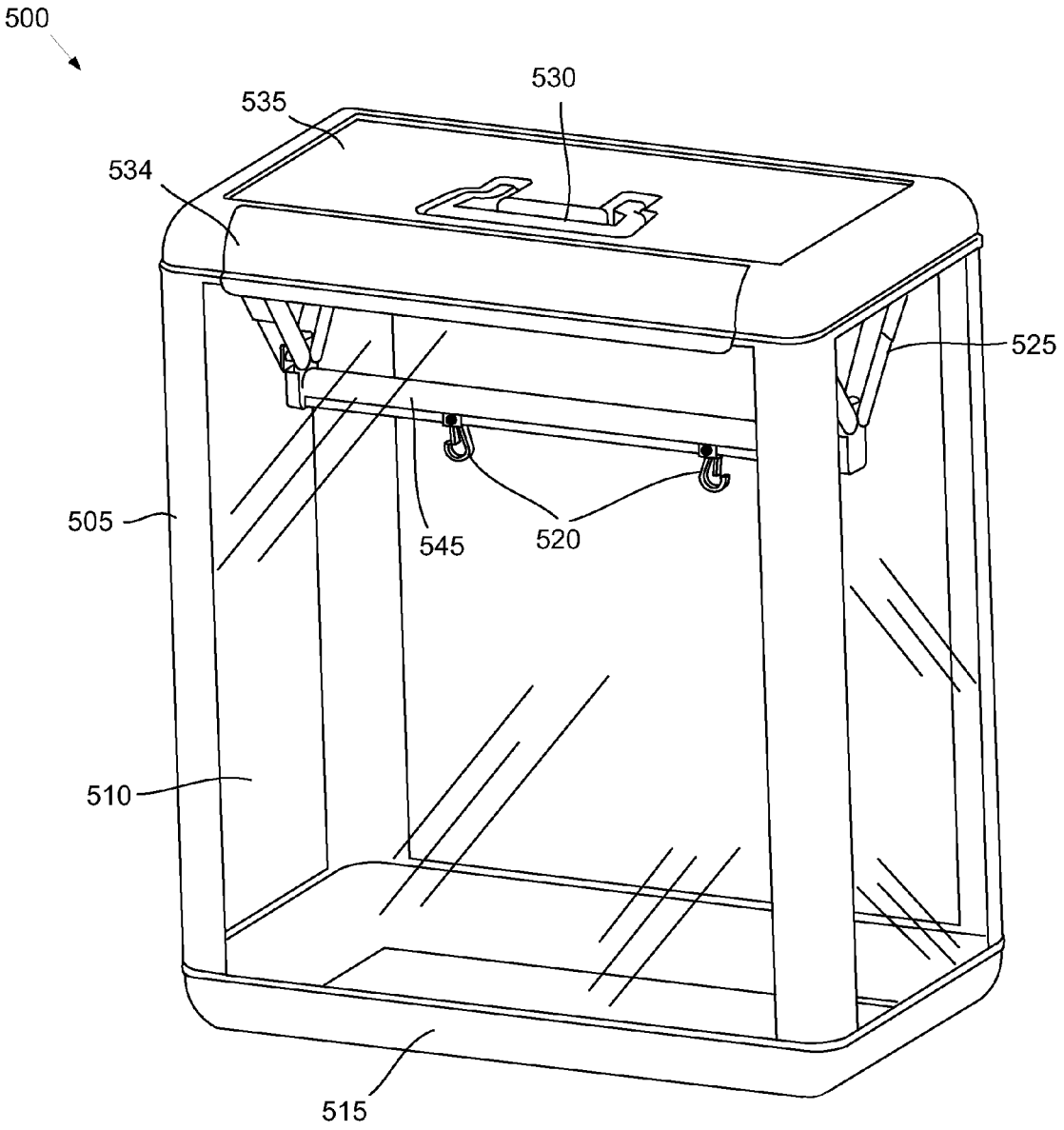
FIG. 5 is a perspective view of an illustrative Handbag Preservation Unit, according to one example of principles described herein.

One alternative example of a Handbag Preservation Unit is shown in FIG. 5 through FIG. 8B. In this example, the Handbag Preservation Unit is designed to store a single handbag. FIG. 5 shows a perspective view of the single Handbag Preservation Unit (500). The unit includes a base (515) with a number of corner pieces (505) extending upward from the base (515). In this example, transparent or translucent windows (510) form the sides of the unit. A lid (535) forms the top of the Handbag Preservation Unit (500). The lid (535) includes a handle (530), latches (534) and an adjustable suspension mechanism (520, 525, 545) extending downward from the bottom of the lid (535). The latches (534) connect the lid (535) to the rest of the structure. The suspension mechanism includes telescoping arms (525) attached to either side of the lid (535). The telescoping arms (525) support a horizontal rod (545). Attachment mechanisms (520) are connected to the horizontal rod (545).

The telescoping arms (525) can be used to adjust the vertical position of the horizontal rod (545) in the Handbag Preservation Unit (500). The attachment mechanisms (520) slide horizontally to adjust horizontal spacing. This allows the suspension mechanism to be adjusted to support a variety of different sizes and styles of handbags. Once in the desired position, both telescoping arms (525) and the attachment mechanisms (520) are configured to remain in place during use.

In one implementation, the components that make up the Handbag Preservation Unit (500) are modular. If additional height adjustment is needed to accommodate a particular purse, the corner pieces (505) and windows (510) can be replaced with longer or shorter pieces. This allows the same lid (535) and base (515) to be used. Additionally, the windows maybe interchangeable/replacable. For example, the windows may be clear, tinted, frosted, etched, colored, or may include various images. Thus, the user or retailer can adjust the look of each unit according to their needs and desires.

Figure 6A:
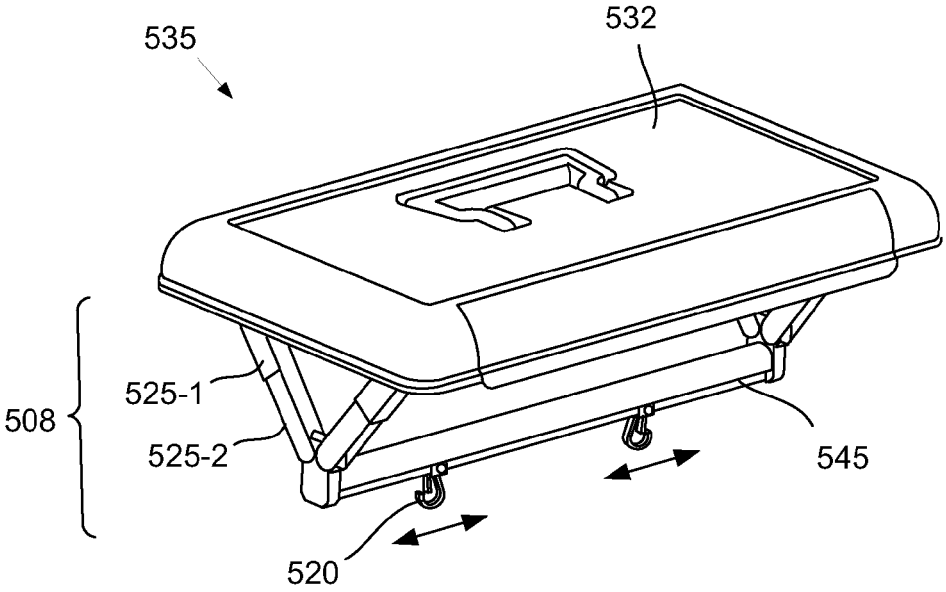
FIGS. 6A and 6B are perspective views of a lid with an adjustable suspension mechanism, according to one example of principles described herein.
Figure 6B:
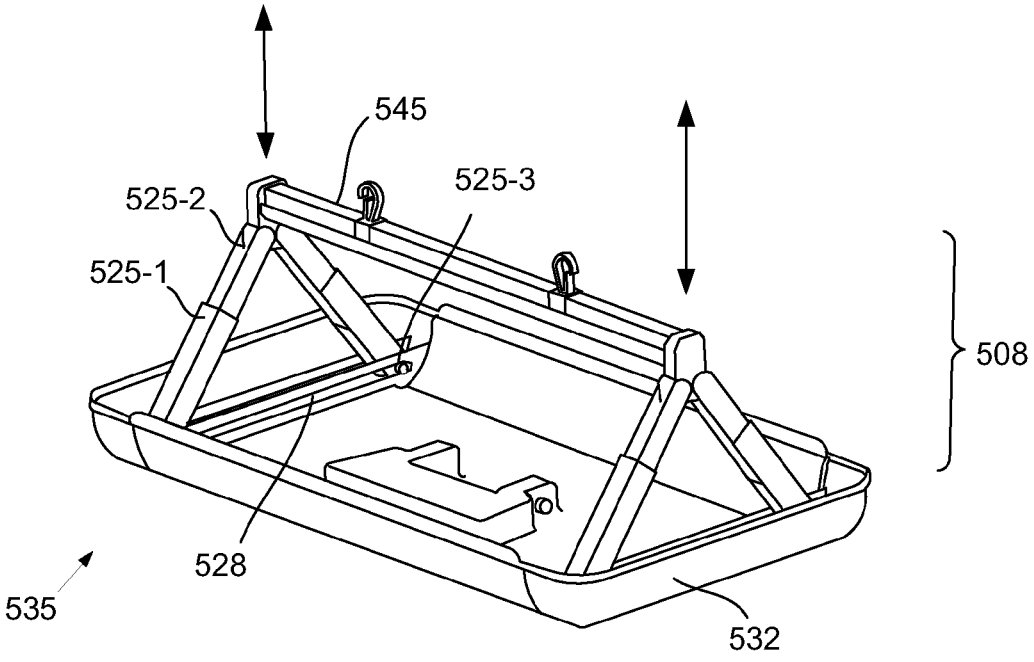

FIGS. 6A and 6B show additional details about the structure and adjustment of the suspension mechanism (508). FIG. 6A shows the top side of the lid (532), with the suspension mechanism (508) extending from the bottom of the lid (532). The suspension mechanism (508) consists of the telescoping arms (525), the horizontal rod (545) and the attachment mechanisms (520). Each of the four telescoping arms (525) includes an outer piece (525-1) and an inner piece (525-2). The inner piece slides (525-2) within the outer piece (525-1) so that the overall length of the telescoping arm (525) can be adjusted. The telescoping arms (525) are joined to the horizontal rod (545) by pin joints. This allows the angle of the telescoping arms (525) to change as the lengths of the telescoping arms are adjusted.

The horizontal rod (545) may include a number of features including pin joints to attach the telescoping arms (525) and tracks to receive the attachment mechanisms (520). In this example, the attachment mechanisms (520) are hooks or other type of fasteners that are designed to connect to rings or other elements on a handbag. The locations of the attachment mechanisms (520) along the horizontal rod (545) can be adjusted as shown by the double headed arrows. In one implementation, the attachment mechanisms (520) include a button (shown by the black circle at the base of the attachment mechanisms) that can be depressed to slide the attachment mechanism (520) along the horizontal rod (545). When the button is released, the attachment mechanism (520) is fixed in position.

FIG. 6B is a perspective view of the underside of the lid (535). This shows tracks (528) on the underside of the lid cover (532) that are configured to receive the ends of the telescoping arms (525). The ends of the telescoping arms (525) slide within the tracks (528) as the length of the telescoping arms (525) are adjusted. The telescoping arm (525) may include a pin (525-3) that secures the telescoping arm (525) in the track (528). In one example, both ends of a pair of telescoping arms (525) slide within the track (528). In other examples, the end of one telescoping arm (525) in the pair may be fixed while the end of the other telescoping arm (525) in the pair may slide within the track (528). By changing the length of the telescoping arms (525) and sliding the telescoping arms (525) within the track (528), the vertical position of the horizontal rod (545) can be adjusted as shown by the double headed arrows. In one implementation, when the telescoping arms (525) are completely retracted, the horizontal rod (545) lays flat against the surface of the lid. This provides a maximum height handbag to be stored in the unit. Additionally, one telescoping arm (525) may be extended farther than the other telescoping arm (525). For example, the front telescoping arms (525) may be extended farther than the rear telescoping arms (525). This shifts the horizontal rod (545) laterally. This can be useful when hanging a bag is asymmetric, such as a shoulder bag.

Figure 7A:
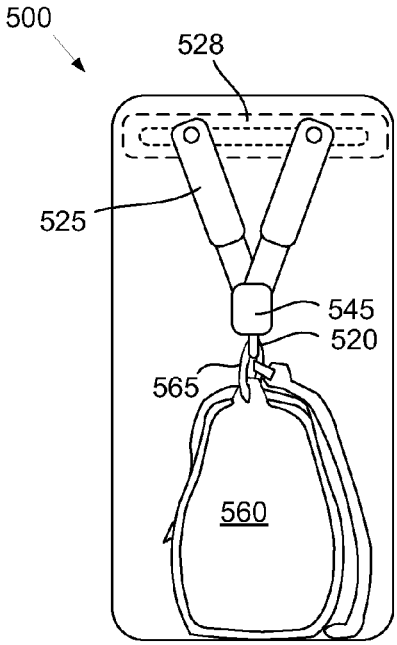
FIGS. 7A and 7B are side and front views, respectively, of a handbag stored in the Handbag Preservation Unit, according to one example of principles described herein.
Figure 7B:
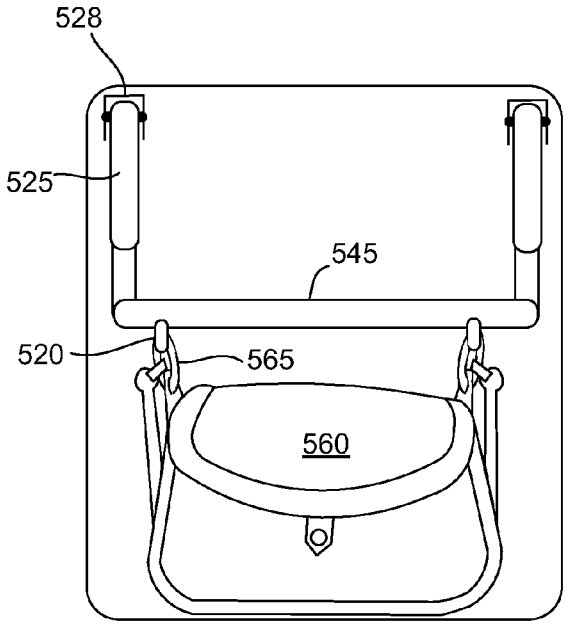

FIGS. 7A and 7B are side and front views, respectively, of a handbag stored in the single Handbag Preservation Unit (500). In this example, the body of the handbag (560) is somewhat rectangular with a relatively flat bottom. The rings (565) connecting the handle to the body of the handbag (560) are spaced relatively far apart. The body of the handbag (560) is also relatively short, as evidenced by the position of the rings (565). To accommodate this shorter handbag (560), the horizontal rod (545) is adjusted to be lower in the unit. This is accomplished by extending the telescoping arms (525) and sliding their upper ends together in the lid track (528). The lower ends of the telescoping arms (525) are pivotably attached to the horizontal rod (545) and pivot as the length and angular position of the arms are adjusted. This results in the horizontal rod (545) being lowered to the desired height. This is best seen in the side view of FIG. 7A. In some embodiments, the telescoping adjustability may be sufficient to provide the desired height adjustment and it may not be necessary for the upper ends of the telescoping arms (525) to slide in the lid track.

The attachment mechanisms (520) are then adjusted along the length of the horizontal rod (545) so that they have the appropriate spacing. As discussed above, it may be desirable for the attachment mechanisms (520) to exert a moderate amount of horizontal tension on the handbag (560) to preserve its shape and to prevent creasing. Once at the desired configuration, the suspension mechanism (508, FIG. 6A) remains stable until it is again adjusted. The components in the suspension mechanism (508, FIG. 6A) may be secured in place using any of a variety of locking or friction mechanisms.

Figure 8A:
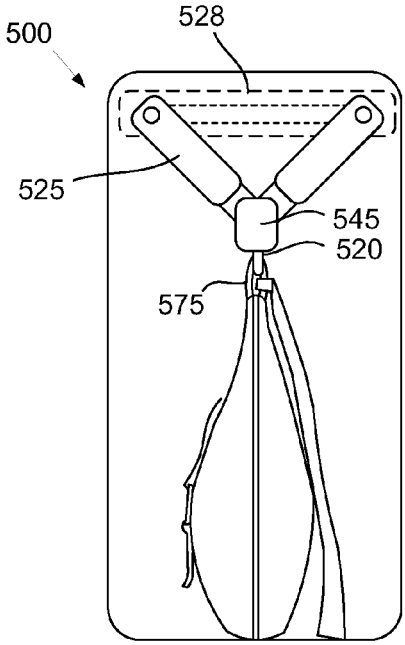
FIGS. 8A and 8B are side and front views, respectively, of a different handbag stored in the Handbag Preservation Unit, according to one example of principles described herein.
Figure 8B:
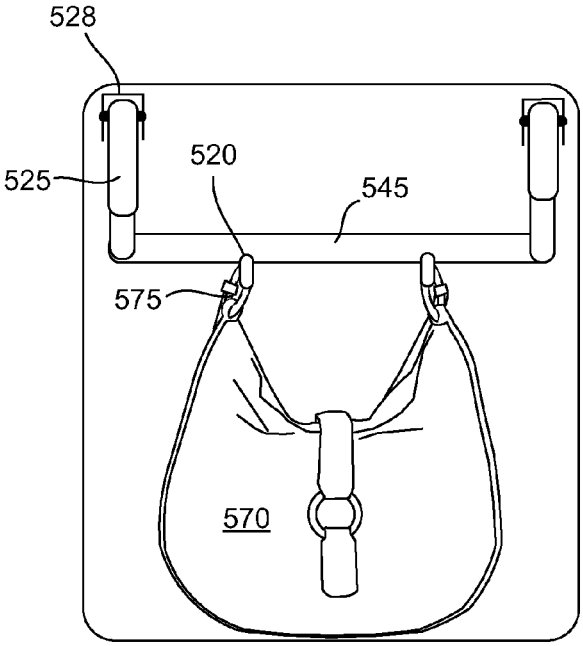

FIGS. 8A and 8B are side and front views, respectively, of a different handbag (570) stored in the same Handbag Preservation Unit (500). This handbag (570) has a more curved shape with a rounded bottom. The handle connection points/rings (575) are closer together and much higher than the handbag (560) shown in FIGS. 7A and 7B. The top of the handbag (570) is designed to form an arc with the ends of the handbag higher than the center of the handbag.

To accommodate this handbag (570), the horizontal rod (545) is raised to shift the attachment mechanisms (520) upward. To raise the horizontal rod (545), the telescoping arms (525) are shortened and the ends of the telescoping arms (525) are moved apart in the track (528) in the lid. The attachment mechanisms (520) are moved closer together on the horizontal rod (545) to achieve the desired spacing. When the connection points/rings (575) are connected to the attachment mechanisms (520), the handbag (570) is supported in the desired shape. In this case, it may be desirable for the attachment mechanisms (520) to exert a slight inward force to maintain the arcuate shape of the handbag (570). This handbag (570) may also benefit from a curved insert placed on the bottom of the Handbag Preservation Unit (500) that conforms to the shape of the bottom of the handbag (570).

Figure 9:
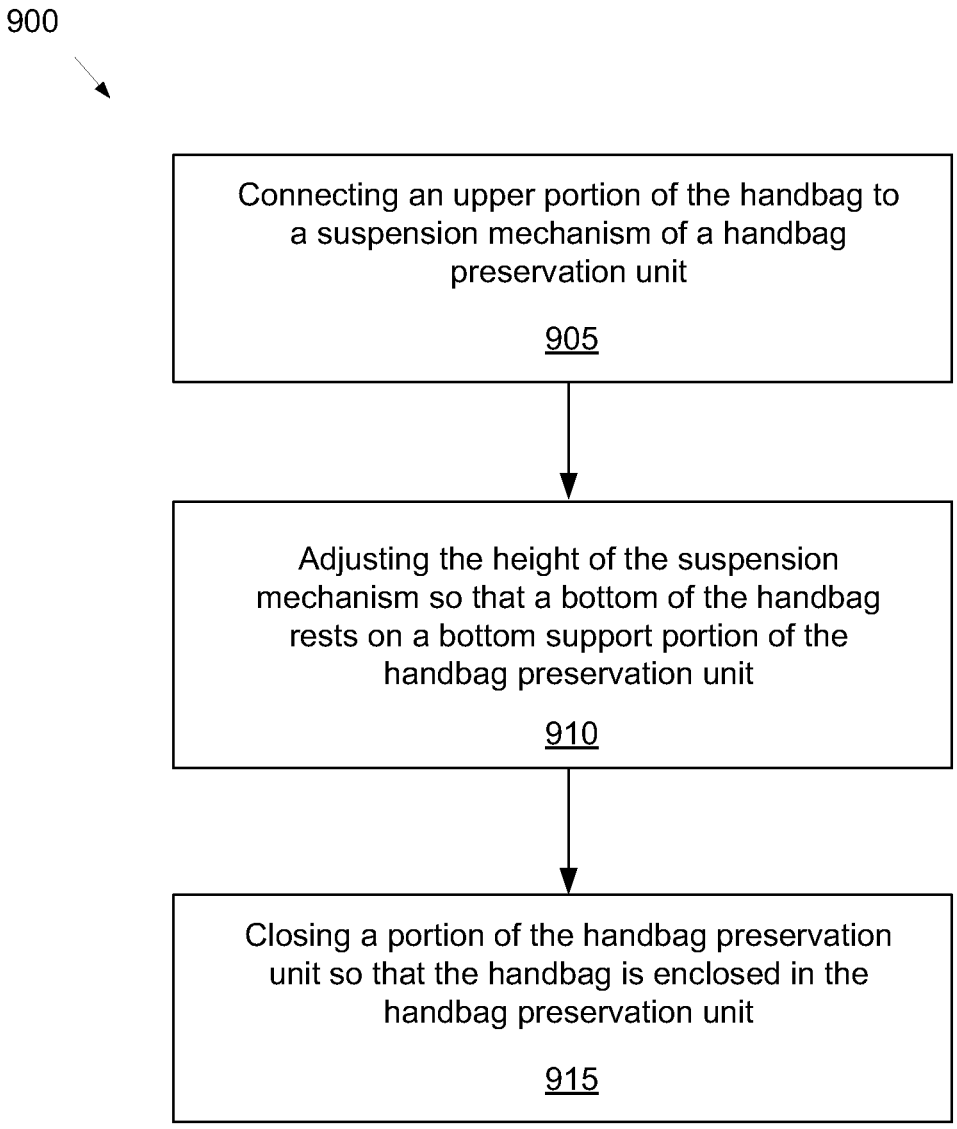
FIG. 9 is a flow chart of an illustrative method for hanging a handbag in the Handbag Preservation Unit, according to one example of principles described herein.

FIG. 9 is a flowchart of one method (900) for storing a handbag in a Handbag Preservation Unit. To place the handbag in the Handbag Preservation Unit, an upper portion of the handbag is connected to a suspension mechanism of the handbag preservation unit (step 905). For example, connecting an upper portion of the handbag to the suspension mechanism may include connecting a hanger to loops or rings in the top corners of the handbag. In other examples, the flap of the purse (if any) can be placed over part of a hanger to support the upper portion of the handbag.

The height of the suspension mechanism is adjusted so that a bottom of the handbag rests on a bottom support portion of the Handbag Preservation Unit or insert (step 910). For example, the attachment mechanism of the hanger to the enclosure can be adjusted so that such the bottom of the handbag is supported by an interior surface of the enclosure. In some examples, the hanger may be connected to a selected point on a rack so that the desired height is achieved. In other examples, the hanger may attach to a loop in a chain or on one peg in an array of pegs. When the suspension mechanism is a resilient member such as a stretch cord, the length of the stretch cord can be adjusted so that the desired height is achieved. As shown in FIGS. 5-8, telescoping arms could provide the height adjustment desired. In some examples, an insert may be placed on the bottom of the enclosure/unit to provide at least a portion of the height adjustability. The insert may have a specific shape desired to support the bottom of the handbag.

A portion of the Handbag Preservation Unit is closed so that the handbag is enclosed in the handbag preservation unit (step 915). For example, closing a portion of the unit may include closing clam shell doors (105, FIG. 1) or fastening a lid (353) onto the shell/sidewalls (505, 510, 515, FIG. 5).

The method described above is only one example. The method may be modified in a variety of ways, including reordering, combining, removing, or adding steps. For example, a step of inserting may include sliding the handbag and suspension mechanism along a fixed path into an interior of the Handbag Preservation Unit. In other examples, a step of placing a shaping element into an interior of the handbag to support a desired shape of the handbag could also be included in the method.

Additional steps that may be used with the single Handbag Preservation Unit (500) illustrated in FIGS. 5-8. The lid (535, FIG. 6) could first be unlatched and removed. The suspension mechanism (508, FIG. 6) could then be adjusted if a different handbag was being stored. The adjustment includes extending/retracting the telescoping arms (525, FIGS. 7 and 8) to change the vertical position of the horizontal rod (545) and adjusting the spacing of the attachment mechanisms (520) along the horizontal rod (545). This allows for the preservation of the desired shape of the handbag by supporting the handbag from both the top and the bottom.

The handbag (e.g. 560, 570) is then connected to the lid/suspension mechanism (508) by connecting rings (565, 575) or other element of the purse to the attachment mechanisms (520). In some examples, the height of the suspension mechanism (508) can be adjusted after the handbag (560, 570) is attached by holding the lid (535) and suspended handbag up to the base and sides. This allows the user to accurately judge the correct height for the suspension mechanism.

If desired, an insert can be placed on the base of the Handbag Preservation Unit (500). The lid (535) and attached handbag (560, 570) are then lowered into the Handbag Preservation Unit (500) and the lid (535) is fastened/latched shut. The handbag is then entirely enclosed in the Handbag Preservation Unit (500). The handbag is supported by both the top and the bottom. The handbag is easily viewed through the windows (510) that form the sides of the Handbag Preservation Unit (500). If the handbag is not supported as desired, the lid (535) can be removed and adjustments made without detaching the handbag from the suspension mechanism (508). When the lid (535) is secured, the Handbag Preservation Unit (500) can be easily carried using the handle (530) on the lid (535). Additionally, the Handbag Preservation Unit (500) can be easily stored on a shelf or stacked while still allowing the handbag to be viewed.

To access the handbag, the latches (534) are opened to disconnect the lid (535). The lid (535), suspension mechanism (508) and handbag (560, 570) connected to the suspension mechanism (508) are removed from the Handbag Preservation Unit (500). The handbag is then disconnected from the attachment points (520) and used as desired.

In general, the principles described above provide for a Handbag Preservation Unit (see e.g. 100, FIGS. 1 and 500, FIGS. 5-8) that includes a suspension mechanism (see e.g. 120, 125, 215, 220, 300, 320 in FIGS. 1-3; and 508, FIG. 6) configured to connect with an upper portion (see e.g. 565, 575 FIGS. 7-8) of a handbag (see e.g. 560, 570, FIGS. 7-8) and support part of a weight of the handbag and a support surface (see e.g. bottom of 100, FIG. 1; and 515, FIG. 5) configured to support a bottom of the handbag and support a remainder of the weight of the handbag. The suspension mechanism is horizontally and vertically adjustable to support a range of different sized handbags. In some implementations, the Handbag Preservation Unit is an enclosed unit and the support surface comprising an interior bottom surface of the enclosed unit. The suspension mechanism may include a variety of attachment mechanisms configured to attach to rings or handles on the upper portion of the handbag. The height of the suspension mechanism with respect to the support surface can be adjusted to accommodate different sized handbags. In some designs, the handbag preservation unit comprises a plurality of the suspension mechanisms (see e.g. FIG. 1) and is configured to store a plurality of handbags. In other designs, the Handbag Preservation Unit may be configured to store a single handbag (see e.g. FIG. 5). Handbag Preservation Unit may include at least one substantially transparent portion (see e.g. 510, FIG. 5) such that a handbag stored in the Handbag Preservation Unit can be viewed from outside the Handbag Preservation Unit.

For example, the Handbag Preservation Unit illustrated in FIGS. 5-8 includes an exterior shell (base 515, corner pieces 505, windows/sidewalls 510) with at least one transparent wall (window 510). The unit also includes a lid (535) connected to the exterior shell, the lid comprising a suspension mechanism (508) in which the suspension mechanism is horizontally and vertically adjustable to accommodate different sized handbags (see e.g. FIGS. 7 and 8). The Handbag Preservation Units allow a handbag to be connected to the suspension mechanism so that it is supported from both a top of the handbag and from a bottom of the hand bag. When the lid (535, FIG. 5) is fastened on the exterior shell (using latches 534), the handbag is entirely surrounded (encapsulated) by the Handbag Preservation Unit.

In one implementation, the suspension mechanism includes telescoping arms (525, FIGS. 5-8) extending from a bottom of the lid. Extending and retracting the telescoping arms adjusts an attachment height of a handbag within the handbag preservation unit. The telescoping arms support a horizontal rod (see e.g. 545, FIGS. 5-8) with adjustable attachment mechanisms (520) positionable along the horizontal rod, wherein positioning the attachment mechanisms along the horizontal rod adjusts a horizontal spacing of attachment points of the handbag. In one embodiment, corner pieces (505) and sidewalls are interchangeable and replaceable. This allows the height of the unit to be adjusted by inserting shorter or taller sidewalls/corner pieces. Additionally, it provides for customization of the look and feel of the unit. For example, corner pieces with a desired look or finish and sidewalls with a desired color or pattern can be used to customize the unit.

The preceding description has been presented only to illustrate and describe examples of the principles described. This description is not intended to be exhaustive or to limit these principles to any precise form disclosed. Many modifications and variations are possible in light of the above teaching.

What is claimed is:

1. A handbag preservation unit comprising:

a suspension mechanism configured to connect with an upper portion of a handbag and support part of a weight of the handbag, the suspension mechanism comprising:

a lid coupleable and removable to and from an exterior of the handbag preservation unit;

a number of telescoping arms adjustable in a vertical direction;

a horizontal rod attached to the telescoping arms; and a number of attachment hooks attached to the horizontal rod to attach a handbag to the lid; and a support surface configured to support a bottom portion of the handbag and support a remainder of the weight of the handbag, wherein the telescoping arms are adjustable to support the handbag via the suspension mechanism and the support surface, and wherein the attachment hooks are horizontally adjustable along the length of the horizontal rod to attach the handbag at a width defined by attachment points of the handbag.

2. The handbag preservation unit of claim 1, in which the handbag preservation unit is an enclosed unit, the support surface comprising an interior bottom surface of the enclosed unit.

3. The handbag preservation unit of claim 1, in which the handbag preservation unit comprises a plurality of the suspension mechanisms and is configured to store a plurality of handbags.

4. The handbag preservation unit of claim 1, in which the handbag preservation unit is a single handbag preservation unit.

5. The handbag preservation unit of claim 1, in which the handbag preservation unit comprises at least one substantially transparent portion such that a handbag stored in the handbag preservation unit can be viewed from outside the handbag preservation unit.

6. A handbag preservation unit comprising:

an exterior shell comprising at least one transparent wall;

a lid coupleable and removable to and from the exterior shell, the lid comprising:

a suspension mechanism comprising:

a number of telescoping arms adjustable in a vertical direction;

a horizontal rod attached to the telescoping arms; and a number of attachment hooks attached to the horizontal rod to attach a handbag to the lid; and a base, wherein the telescoping arms are adjustable to support the handbag via the suspension mechanism and the base, and wherein the attachment hooks are horizontally adjustable along the length of the horizontal rod to attach the handbag at a width defined by attachment points of the handbag.

7. The handbag preservation unit of claim 6, in which when the lid is fastened on the exterior shell, the handbag is entirely surrounded by the handbag preservation unit.

8. The handbag preservation unit of claim 6, wherein the exterior shell comprises a base, interchangeable corner pieces and replaceable sidewalls.

9. The handbag preservation unit of claim 6, further comprising a handle coupled to the lid.

10. The handbag preservation unit of claim 6, further comprising a number of notches defined along the length of the horizontal bar in which the attachment hooks couple to the horizontal bar.

11. The handbag preservation unit of claim 6, further comprising a number of tracks defined along the length of the horizontal bar on which the attachment mechanisms are slidably attached.

12. The handbag preservation unit of claim 11, further comprising a releasing mechanism to selectively release and secure the attachment mechanisms at a number of positions along the length of the horizontal bar.

13. A method for manufacturing a handbag preservation unit, the method comprising:

connecting a suspension mechanism to an enclosure, the enclosure comprising a number of walls and a bottom support portion, the suspension mechanism being adjustable so that a bottom of the handbag rests on the bottom support portion of the handbag preservation unit; and connecting a lid to the enclosure for closing a portion of the handbag preservation unit so that the handbag is enclosed in the handbag preservation unit, wherein the suspension mechanism comprises:

a number of telescoping arms adjustable in a vertical direction;

a horizontal rod attached to the telescoping arms; and a number of attachment hooks attached to the horizontal rod to attach a handbag to the lid, wherein the telescoping arms are adjustable to support the handbag via the suspension mechanism and the bottom support portion, wherein the attachment hooks are horizontally adjustable along the length of the horizontal rod to attach the handbag at a width defined by attachment points of the handbag, and wherein the suspension mechanism is coupled to the lid.

* * * * *